US006949702B2

(12) United States Patent
Ortega et al.

(10) Patent No.: US 6,949,702 B2
(45) Date of Patent: Sep. 27, 2005

(54) DRUMHEAD QUICK DISCONNECT

(75) Inventors: Mark Ortega, 126 S. Maple, Blue Island, IL (US) 60406; Robert W. Connors, Lake Barrington, IL (US)

(73) Assignee: Mark Ortega, Matteson, IL (US)

( * ) Notice: Subject to any disclaimer, the term of this patent is extended or adjusted under 35 U.S.C. 154(b) by 0 days.

(21) Appl. No.: 10/623,263

(22) Filed: Jul. 18, 2003

(65) Prior Publication Data

US 2005/0011338 A1 Jan. 20, 2005

(51) Int. Cl.[7] ..... G01D 13/04

(52) U.S. Cl. ..... 84/413; 84/411 A; 84/415; 84/411 R

(58) Field of Search ..... 84/413, 411 A, 84/415, 419, 411 R, 412

(56) References Cited

U.S. PATENT DOCUMENTS 4,244,266 A 1/1981 Hardy
4,254,685 A 3/1981 Rose
4,278,003 A 7/1981 Hanson
4,312,259 A 1/1982 Henrit
4,325,280 A 4/1982 Hardy
4,520,709 A 6/1985 Kester, Jr.
4,709,613 A * 12/1987 Powers et al. ..... 84/413
4,742,508 A 5/1988 Lee et al.
4,798,121 A 1/1989 Donohoe
4,809,582 A 3/1989 Chang
5,098,524 A 3/1992 Antalfy et al.
5,335,575 A 8/1994 Hoshino
5,349,891 A 9/1994 Belli
5,385,076 A 1/1995 Belli
5,417,136 A 5/1995 Kralik et al.
5,493,942 A 2/1996 Wolf
5,554,812 A 9/1996 Donohoe
5,610,350 A 3/1997 Miller
5,703,306 A 12/1997 Liao
5,739,449 A 4/1998 Torres, Jr
5,756,917 A 5/1998 Watanabe et al. .
5,864,077 A 1/1999 Gatzen
5,892,168 A 4/1999 Donohoe
5,986,197 A 11/1999 Allen
5,994,634 A 11/1999 Cady
6,018,116 A 1/2000 Simons et al.
6,040,513 A 3/2000 Belli
6,040,514 A 3/2000 Liao
6,073,999 A 6/2000 Crane
6,091,011 A 7/2000 Simons et al.
6,093,877 A 7/2000 Nichel
6,175,068 B1 1/2001 Belli
6,215,054 B1 4/2001 Woodhouse et al.
6,242,680 B1 6/2001 Benton, Jr.
6,255,573 B1 7/2001 Izen et al.
6,278,045 B1 8/2001 Reyes
6,297,177 B1 10/2001 Belli et al.
6,300,551 B1 10/2001 Adinolfi
6,307,133 B1 10/2001 May et al.
6,350,941 B1 2/2002 Miller et al.
6,362,408 B1 3/2002 Chang
6,410,833 B1 6/2002 Brando
6,416,029 B1 7/2002 Holtermanns
6,441,286 B1 8/2002 Brando et al.
6,489,547 B2 12/2002 Chang
6,492,583 B1 * 12/2002 Wilkey ..... 84/413
6,525,250 B2 2/2003 Goods
6,570,074 B1 * 5/2003 Rode ..... 84/413
6,580,023 B2 6/2003 Belli

* cited by examiner

*Primary Examiner*—Shih-Yung Hsieh
(74) *Attorney, Agent, or Firm*—Bell Boyd & Lloyd, LLC

(57) ABSTRACT

A quick disconnect that enables a drummer to quickly remove and apply tension to a drumhead of a drum is provided. The disconnect is operable with many types of drums, such as a conga drum. The disconnect allows a drummer at the end of a playing session to quickly release tension from the drumhead and thereby preserve the head and the barrel portion of the drum. Further, when the drummer wants to use the drum again, the quick disconnect allows the drummer to quickly reapply tension to the drumhead, wherein the tension reapplied is substantially the same as the tension applied immediately prior to the previous release of the disconnect.

22 Claims, 7 Drawing Sheets

DRUMHEAD QUICK DISCONNECT

BACKGROUND OF THE INVENTION

This invention relates to drums, and more particularly to devices for tensioning drumheads. The pitch of a drum is determined by the tension on the drumhead. While the tension on the drumhead is adjustable, adjustment of the head tension is a time consuming process. FIG. 1 shows a typical arrangement for a drumhead attachment. A drum 10 consists of a drum barrel 12 and a drumhead 14, which is positioned on top of barrel 12. The head 14 has a downwardly extending annular portion 16 that covers the top opening of barrel 12. A hoop 18 extends outwardly from annular portion 16.

A tensioning ring 20 is placed over the annular portion 16 of the head 14. Ring 20 enables a tensioning force to be applied evenly to the annular portion 16 of the drumhead 14. Bracket 22 is attached to the ring 20 via fasteners 24. Bracket 22 has bent legs 26 that extend outwardly and downwardly around hoop 18.

A lug 28 hooks over bracket 22 and transfers a tensioning force thereto. The tensioning force is transferred to the legs 26 of bracket 22, through ring 20, and to hoop 18 and portion 16 of head 14. The tensioning force is created by nuts 30, which are threaded against a bottom 32. Bottom 32 abuts a collar 34 that is fixed to barrel 12 via flange 36 and fasteners 24. A washer 38 is placed between the nuts 30 and the bottom 32. The upper nut 30 serves to increase or decrease the amount of tension applied by lug 28, while the lower nut 30 serves as a locking nut to hold a set tension, i.e., pitch of the drum, at a desired setting.

Known drums use a plurality of the above-described lug assemblies, such as six assemblies, to tension the drumhead 14. Tightening or loosening all of the lugs 28 to vary the tension on drumhead 14 is a time consuming process. Moreover, to preserve drumhead 14 it is recommended to loosen nuts 30 after each use, requiring the drummer to retighten the nuts 30 to the desired tuning tension the next time the drum is used. Such a procedure is cumbersome and consequently not followed in many instances, placing undue stress on both the drumhead 14 and the barrel 12.

A need therefore exists for an apparatus that allows the drummer to quickly tighten and loosen the drumhead 14, so that the drummer can remove tension from the head 14 after each use. It is also desirable that the device enable the previous tension, i.e., tuning setting, to be reestablished quickly upon tensioning the head after the head 14 has been loosened.

SUMMARY OF THE INVENTION

The present invention includes a quick disconnect that allows a drummer, after using a drum, to quickly loosen a lug or tensioning latch that applies tension to the drumhead of a drum while the drum is being used. The quick disconnect has a snap-type action that allows the drummer to quickly release tension after use. The snap-action also allows the drummer to quickly apply tension to the drumhead upon the next use. The reapplied tension is at or near the previous tension or pitch setting.

A plurality of the quick disconnect/lever assemblies are spaced around the barrel of the drum. The lug, or tensioning latch, hooks over a bracket that attaches to a tensioning ring. The tensioning ring is placed over the outside of the drumhead and rests on top of a hoop that extends outwardly from a downwardly extending portion of the drumhead. The tensioning ring distributes force from the quick disconnect tensioners of the present invention evenly about the hoop and downwardly extending portion of the drumhead.

The quick disconnect in one embodiment replaces the lug 28, bottom 32 and nuts 30, as those elements have been described above, but otherwise operates with the existing bracket 22 and collars 34/flange 36 of the drum. In that manner, the quick disconnect of the present invention provides a convenient retrofit for existing drums.

In an alternative embodiment, the flange 36 and collar 34, described above, are replaced with a quick disconnect assembly, wherein the drummer removes and replaces the screws 24 holding the flange 36 to the barrel 12 of drum 10 to attach the alternative quick disconnect.

The latch of the quick disconnect connects pivotally to a lever arm. The lever arm in turn connects pivotally to a mount. The mount is then attached to a member that in turn is coupled to collar 34, which is fixed to flange 36. In an alternative embodiment, flange 36 is integral to or fixed to the mount to which the lever arm connects pivotally. That is, the collar 34 is eliminated.

In each of the embodiments described herein, the latch can be adjusted to enable the drummer to set the tension to achieve a desired pitch. When the quick disconnect is reapplied or reconnected to apply tension to the drumhead, the latch reapplies the previously set amount of tension or is substantially close to providing the previously set amount of tension. In one embodiment, the latch is secured in position by knurled knobs, butterfly handles or other type of adjustment devices that enable the drummer to adjust the position of the latch and thus the tension on the drumhead by hand.

The present invention is hereafter described in connection with a conga drum. It should be appreciated however that the present invention is expressly not limited to conga drums and instead applies to any type of drum having a drumhead that is held in place via tension provided by an adjustable tensioner.

It is therefore an advantage of the present invention to provide a quick disconnect for a drumhead.

It is another advantage of the present invention to provide a device that enables a drummer to easily remove tension and apply tension to a drumhead.

It is a further advantage of the present invention to provide a device that enables a drum to be tuned quickly.

Moreover, it is an advantage of the present invention to provide a connection apparatus that enables the tension to be removed readily from a drumhead after play of the drum.

It is still another advantage of the present invention to provide a quick disconnect that retrofits existing drums.

Still further, it is an advantage of the present invention to provide a disconnect device for a drum that readily replaces existing tensioning devices.

Yet another advantage of the present invention is to provide a quick disconnect device for a drum that does not have loose pieces that come apart from the drum, requiring the drummer to store and maintain the whereabouts of said loose pieces.

Additional features and advantages of the present invention are described in, and will be apparent from, the following Detailed Description of the Invention and the figures.

DETAILED DESCRIPTION OF THE INVENTION

The present invention includes various embodiments for a quick disconnect that enable a drummer to quickly remove and apply tension to a drumhead of a drum. The disconnects described herein are operable with many types of drums, such as a conga drum. The disconnects allow a drummer at the end of a playing session to quickly release tension from the drumhead and thereby preserve the head and the upper rim of the barrel of the drum. Further, when the drummer wants to use the drum again, the quick disconnects allow the drummer to quickly reapply tension to the drumhead, wherein the tension applied is substantially the same as the tension applied immediately prior to the previous release of the disconnects. That is, the quick disconnect devices of the present invention enable the drummer to quickly apply an amount of tension that is either at or substantially close to the tension needed for the drumhead to be in tune.

The drum uses multiple quick disconnects, such as two to ten of the quick disconnects. For ease of illustration, the drawings below show only a single disconnect. In one preferred embodiment, multiple ones of quick disconnects shown below are evenly spaced about the drum, so that the tension applied by those disconnects is distributed substantially evenly to the drumhead.

The disconnects described herein each include a mechanism that allows the drummer to readily adjust the amount of tension applied by the disconnects. Furthermore, each of the embodiments described herein is readily attached to or retrofitted to existing drums. FIGS. 1 to 5 show sections of a conga drum. It should be appreciated however that the quick disconnects described herein are operable with any type of drum requiring a drumhead, e.g., a porous drumhead, to be tensioned, such as conga drums, bongos, djembe drums, ashikos, doumbeks, tabor, bombo, klong yaw, taval, sakara, mridangam, hudak, naals, dhols, dholks, tupan, djun-djuns, coffeehouse, standing, tabla, talking, madals, zarbs and other types of drums.

Figure 2A:
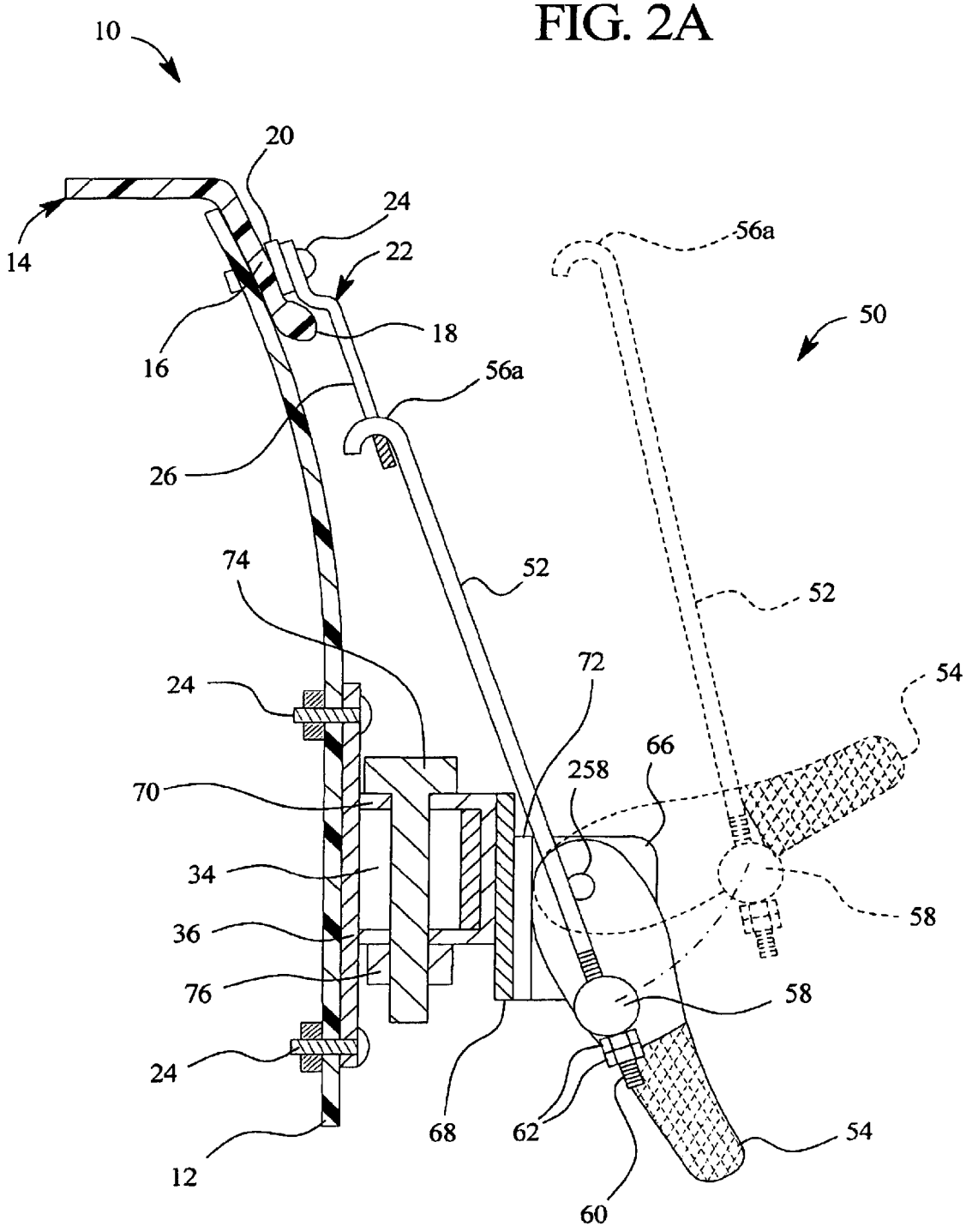
FIGS. 2A and 2B are sectioned side elevation views of one type of embodiment of the drumhead quick disconnect of the present invention.
Figure 2B:
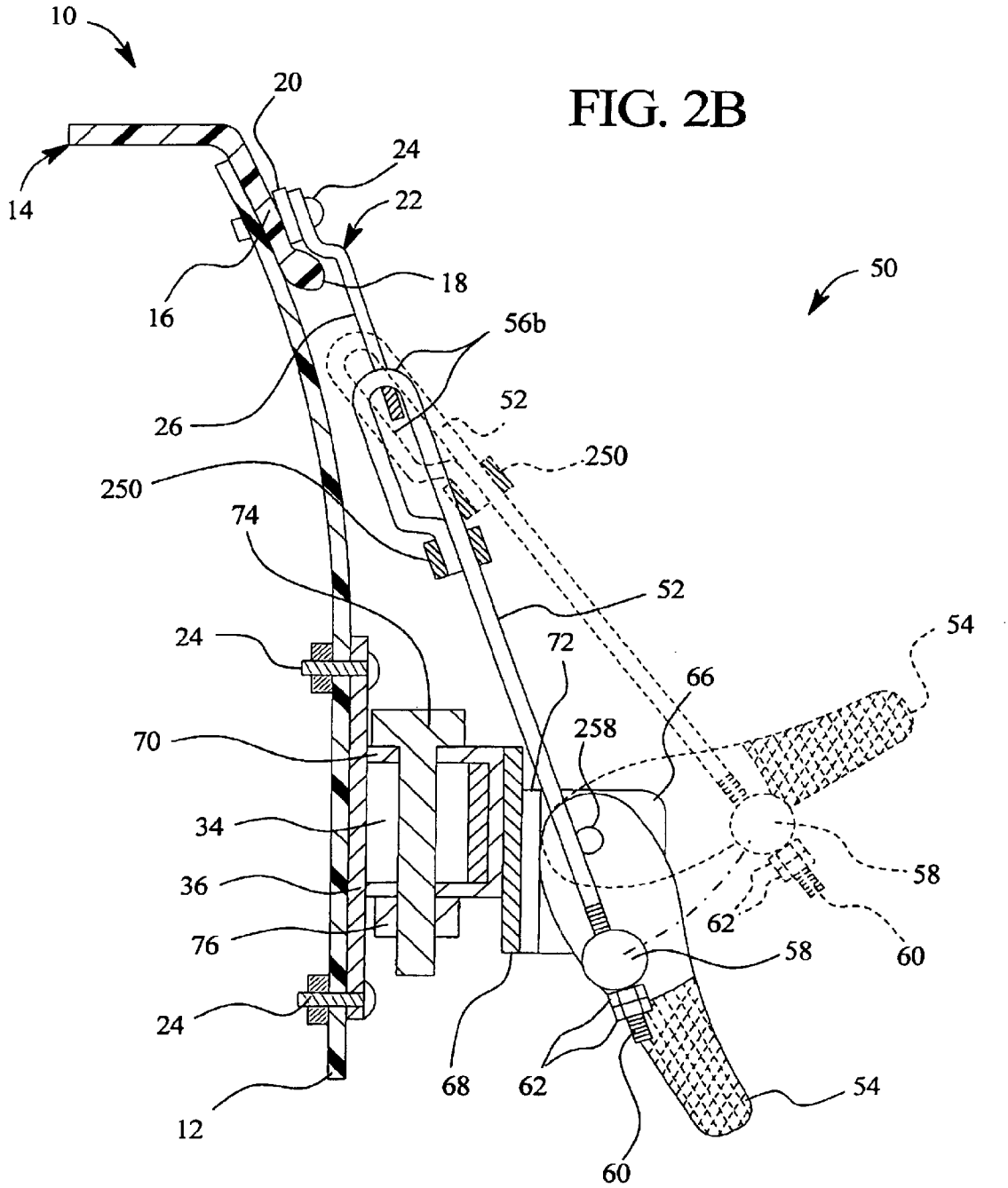
Figure 3:
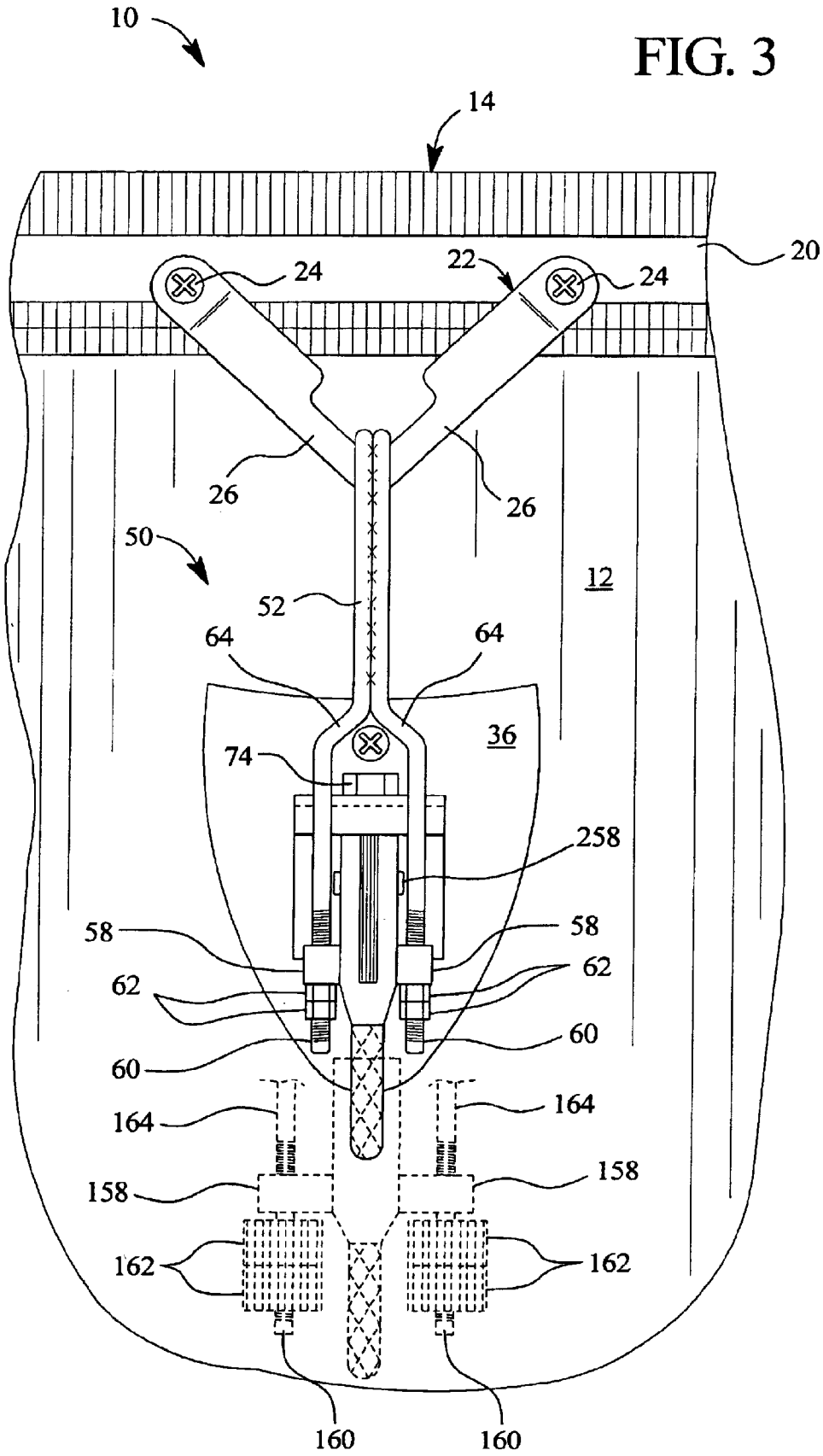
FIG. 3 is a sectioned front elevation view of the quick disconnect of FIGS. 2A and 2B.

Referring now to FIGS. 2A and 2B, multiple versions of one embodiment of a quick disconnect of the present invention are illustrated as disconnect 50. Disconnect 50 operates with drum 10, which includes the barrel 12 and the drumhead 14. Drumhead 14 has a downwardly extending section 16 that covers and resides along a top section of barrel 12. A hoop 18 extends outwardly from portion 16. Tension ring 20 is positioned outside of portion 16 and on top of hoop 18. Bracket 22 connects to tension ring 20 via fasteners 24. Bracket 22 includes legs 26 that come together to form a V-shaped bracket 22 as seen in FIG. 3. Bracket 22 is connected to ring 20 via fasteners 24. The drum also includes the flange 36 and collar 34 as described above. In the embodiments illustrated in FIGS. 2A, 2B and 3, the quick disconnect 50 fixes to or attaches to collar 34. In alternative embodiments illustrated in FIGS. 4A and 4B, collar 34 is removed and the quick disconnect is alternatively fastened to flange 36.

Quick disconnect 50 includes a latch 52 and a lever arm 54. Latch 52 includes a hook portion 56*a* in FIG. 2A. Hook portion 56*a* fits over and applies tension to the interface between legs 26 of bracket 22. In FIG. 2A, hook position 56*a* is sized to allow latch 52 to come free from bracket 22 when tension is released. In FIG. 2B, hook position 56*b* is extended so that latch 52 does not come free from bracket 22 when tension is released.

Latch 52 connects pivotally to lever arm 54 via pivot 58. In the illustrated embodiment, pivot 58 defines an aperture that allows latch 52 to extend therethrough. Latch 52 has threaded ends 60 that enable nuts 62 to thread thereon. Nuts 62 are positioned or tensioned onto latch 52 so that latch 52 creates a desired amount of tension against bracket 22 when lever arm 54 is locked in its position.

For the "swing away" embodiment of FIG. 2A, FIG. 3 illustrates that in one embodiment, latch 52 splits into two segments 64, wherein the end of each segment has threads 60. A set of nuts 62 threads onto each thread 60 of each segment 64. The break point in latch 52, where segments 64 being to fork, is positioned in one preferred embodiment so that when the latch swings down, the space created between segments 64 clears or extends over the latch 54, or as shown below, the latch is provided with a clip that snaps onto the lever arm to hold latch 52 in place. For the looped connection of FIG. 2B, the break point is positioned so that a removable band 250 or other removable locking mechanism can be readily placed around latch 52 and extended hook portion 56*b*. If locking mechanism 250 is removed, extended hook position 56*b* can be bent slightly open in one embodiment to be removed from bracket 22 if needed.

FIG. 3 illustrates an alternative embodiment, wherein an alternative pivot 158 is extended further outwardly so that alternative segments 164 can be spaced more widely apart. The wider-spaced segments 164 allow for wider adjustment devices 162 to be used so that the drummer can adjust the tension of the quick disconnect tensioning device 50 by hand in one embodiment by turning devices 162 against threaded ends 160. The radius of alternative pivot 158 is in one embodiment increased, allowing for a larger through-hole and consequently a larger diameter stud end 160 to be employed. The alternative apparatus is shown in phantom for clarity.

Segments 64, 164 of latch 52 are welded together in one embodiment. In another embodiment, latch 52 is an integral piece that is formed to have segments 64, 164 and threaded ends 60, 160. In one embodiment, latch 52, as well as lever arm 54 and the other components of quick disconnect 50, are metal, such as stainless steel, steel, aluminum, brass, copper, nickel or any alloy or combination thereof. In an alternative embodiment however, a portion or all of disconnect 50 can be a synthetic or composite material. Portions of quick disconnect 50 may also have a plastic or synthetic coating.

Pivot 58 connects pivotally to lever arm 54. Lever arm 54 in turn connects pivotally via pivot 258 to mount 66. When lever arm 54 is moved pivotally in the clockwise direction as seen in FIGS. 2A and 2B towards barrel 12, the lever arm 54 pulls pivot 58 and latch 52 downward and eventually locks same in position. Lever arm 54 remains in a locked position until the drummer unlocks or unsnaps lever arm 54 by moving the lever arm in the counterclockwise direction as seen in FIGS. 2A and 2B. The locking mechanism that locks lever arm 54 in place with respect to mount 66 is known to those of skill in the art and can be obtained from various sources, such as Carr Lane Manufacturing Co., St. Louis, Mo., or from distribution outlets such as McMaster Carr Supply Company, Chicago, Ill.

Mount 66 is welded to or fastened to a base 68. Base 68, in turn, is connected to a U-channel 70. U-channel 70 fits snugly over the collar 34, which is fixed to flange 36, which in turn is connected to barrel 12. In an alternative embodiment, if U-channel 70 is sized sufficiently to support a flange portion 72 of mount 66, then flange portion 72 can mount directly to U-channel 70, without an intermediate base 68. FIGS. 2A and 2B also illustrate the lever arm 54 and the latch 52 in phantom in the disconnected position, showing that as the drummer unsnaps lever arm 54 and moves same counterclockwise, as seen in FIGS. 2A and 2B, pivot 58 pivots upwardly as does latch 52. Latch 52 moves completely away from arms 26 of bracket 22 in FIG. 2A and away from but loosely connected to arms 26 of bracket 22 in FIG. 2B. When reapplying tension to the drumhead 14, lever arm 54 is lowered and latch 52 is pivoted until hook portion 56 (collectively 56*a* and 56*b*) meets bracket 22, wherein lever arm 54 is thereafter snapped into the locking position shown in solid in FIG. 2.

U-channel 70 defines a plurality of apertures that allow a bolt or other type of fastener 74 to extend therethrough and to fasten U-channel 70 to collar 34. Bolt 74 receives a nut 76 that may be loose or welded to U-channel 70. Alternatively, U-channel 70 is tapped to receive bolt 74. Although not illustrated, U-channel 70 includes one or more tabs that extend from and restrain U-channel 70 from moving laterally with respect to collar 34.

Figure 1:
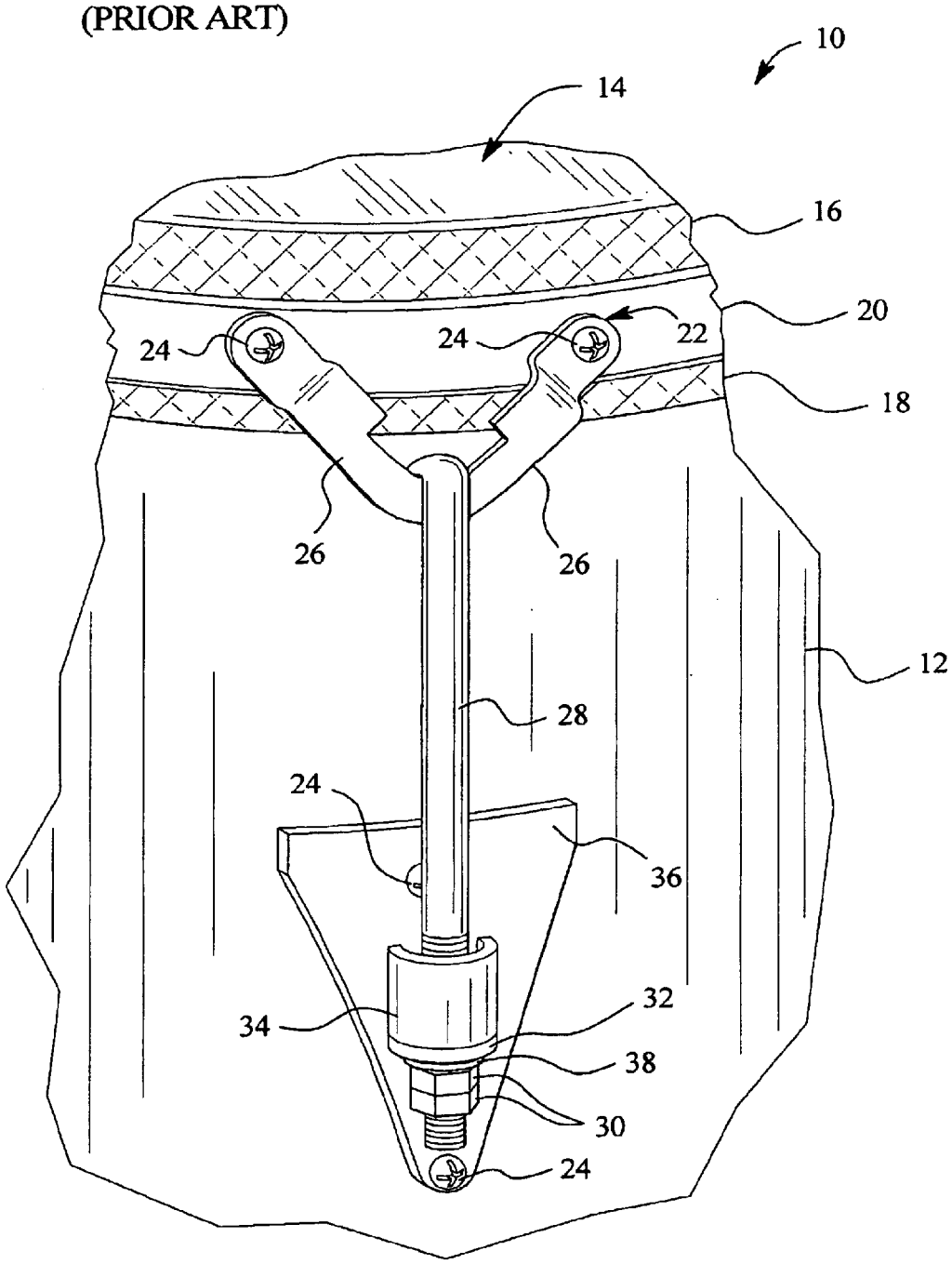
FIG. 1 (PRIOR ART)
FIG. 1 is a perspective view of a section of a prior art configuration for tensioning a drumhead.

Quick disconnect 50 is advantageous in one respect because it mounts directly to the flange 36 and collar 34 illustrated in FIG. 1. Therefore, lug 28 and nuts 30 of FIG. 1 can simply be replaced by the U-channel 70, base 68, mount 66, latch 52 and lever arm 54 of quick disconnect 50, shown in FIGS. 2A, 2B and 3. In such a case, collar 34, flange 36 and quick disconnect 50 mount to barrel 12 of drum 10 via fasteners 24.

The quick disconnect 50 of FIGS. 2A, 2B and 3 is advantageous in another respect. When the drummer discontinues play of the drum and unlocks or unsnaps quick disconnect 50 to release tension from drumhead 14 (drummer releases multiple quick disconnects 50 to completely loosen the tension from drumhead 14), the latch 52 rotates clockwise as illustrated in FIG. 2A about pivot 58. Eventually, latch 52 rotates until it hangs substantially vertically downward in FIG. 2A. In FIG. 2B, latch 52 remains loosely connected around arms 26 of bracket 22. Advantageously, in FIGS. 2A and 2B the latches do not come free from quick disconnect 50. If otherwise, the drummer would have to store the latches 52 until the next time the drummer desired to play drum 10, wherein the drummer would then have to find the multiple latches 52 for the multiple quick disconnects 50 used on drum 10.

Quick disconnect 50 is self-contained and is ready to be used to reapply the same, or close to the same, amount of tension each time the drummer decides to play the drum, wherein the drummer simply flips the latch 52 over bracket 22 and locks lever arm 54 in FIG. 2A or simply locks lever arm 54 in FIG. 2B. Adjustment devices such as nuts 62, 162, enable the drummer to make fine adjustments to the pitch of drumhead 14 when disconnect 50 is re-tensioned.

Figure 4A:
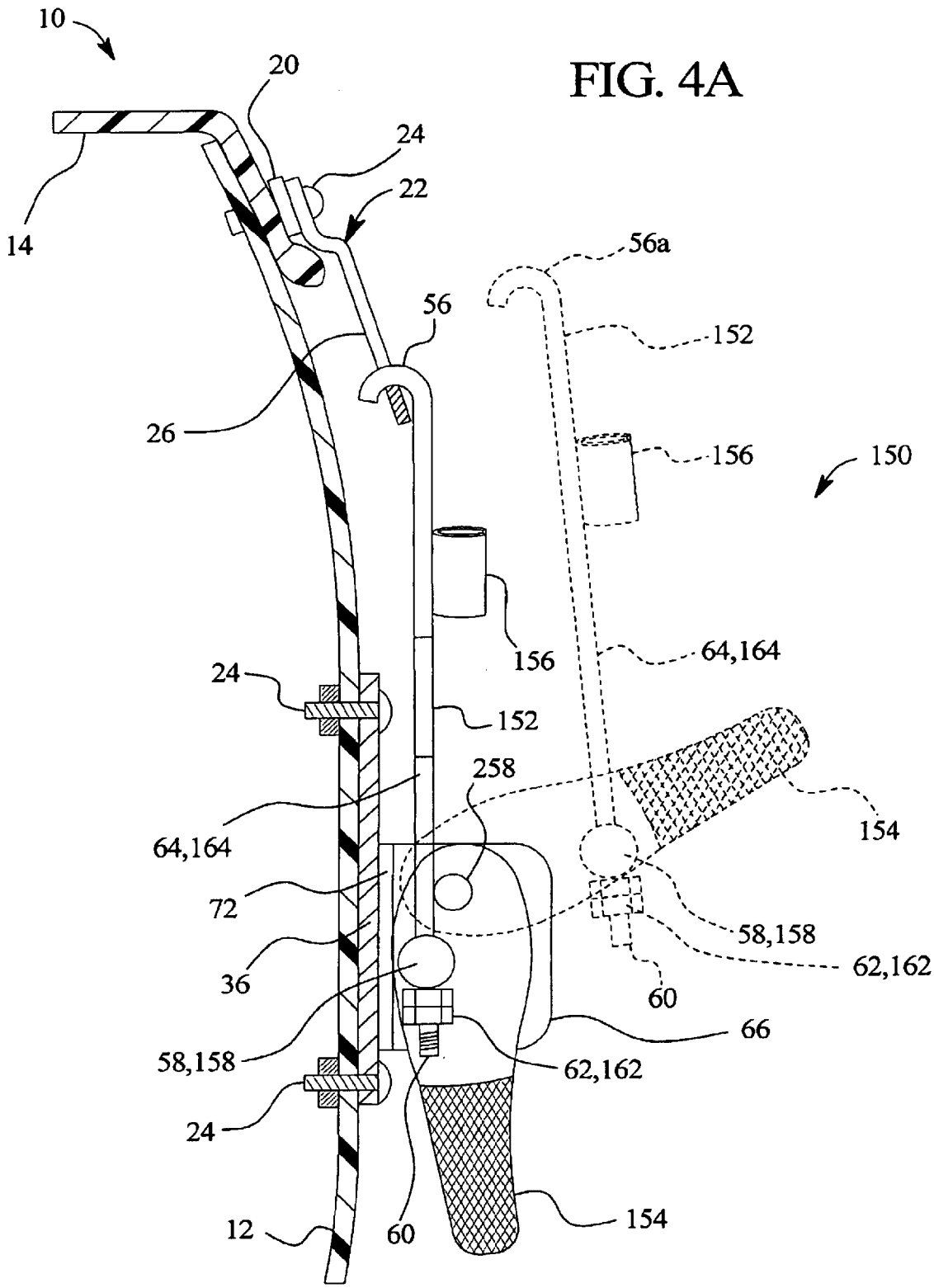
FIGS. 4A and 4B are sectioned side elevation views of an alternative type of embodiment of the drumhead quick disconnect of the present invention.
Figure 4B:
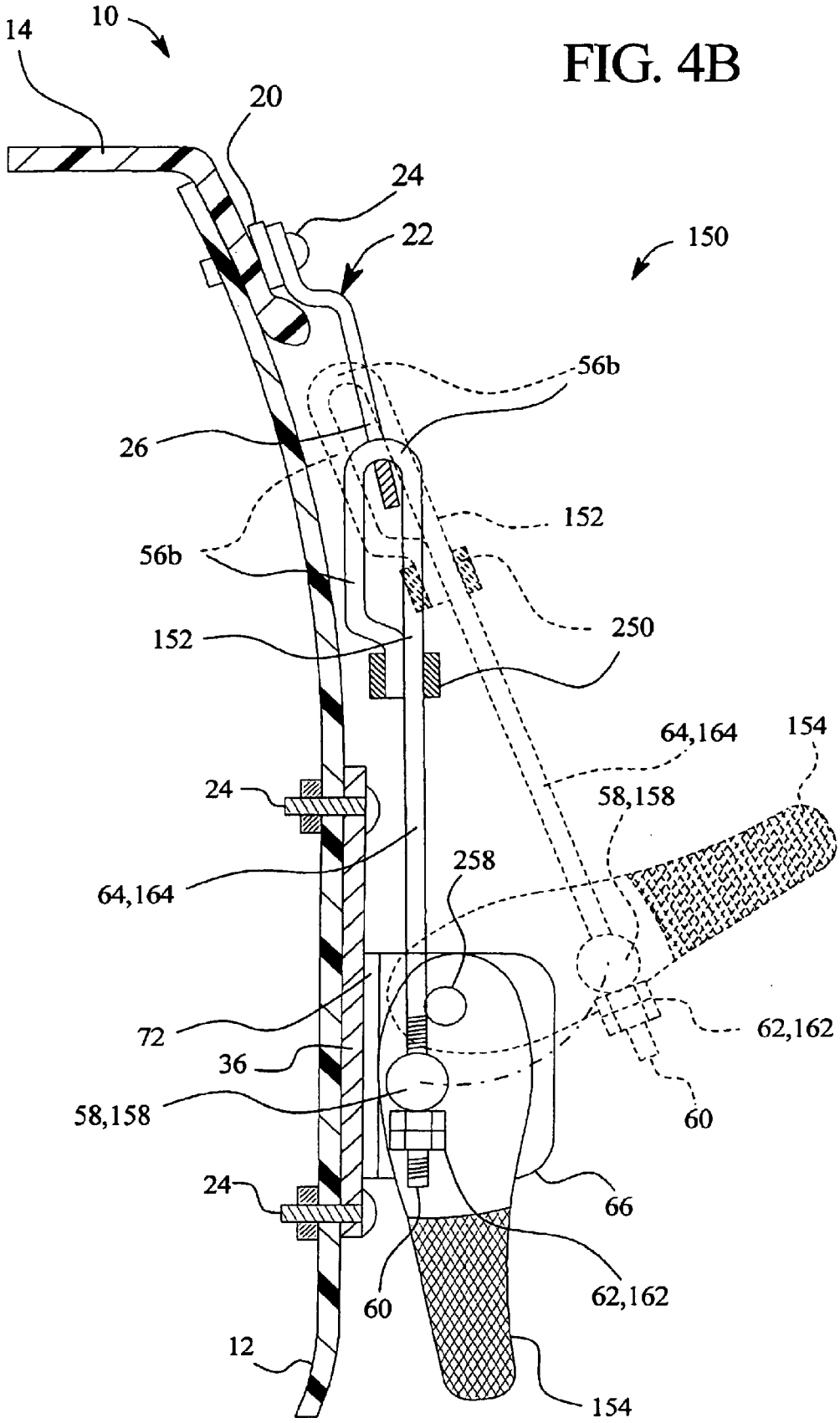

Referring now to FIGS. 4A and 4B, multiple versions of an alternative quick disconnect 150 are illustrated. Quick disconnect 150 includes many of the same components described for quick disconnect 50, including a latch and a lever arm. Lever arm 154 of FIG. 4A is longer than lever arm 54 of FIGS. 2A, 2B and 3. Accordingly, alternative latch 152 of FIG. 2A includes a clip 156 that snaps onto the handle of lever arm 154 when the latch 152 is rotated about pivot point 58 or 158 away from bracket 22. Latch 152 of FIG. 4A includes the hook portion 56*a* described above and operates as described above in connection with FIG. 2A. Latch 152 of FIG. 4B includes the hook portion 56*b* described above and operates as described above in connection with FIG. 2B.

Alternative quick disconnect 150 is operable with the pivots 50 and 158 described above. Accordingly, nuts or adjustment members 62 or 162 can be used respectively. Latch 152 also includes segments 64 or 164, accordingly. Each of the segments 64 or 164 includes a threaded end 60 that is inserted through pivot 58 or 158 to receive adjustment devices 62 or 162, respectively.

With disconnect 150, the collar 34, base 68, U-channel 70 and associated hardware are eliminated. Instead, flange portion 72 of mount 66 is welded to or otherwise fastened to flange 36. Flange 36 in turn bolts to barrel 12 via fasteners 24, as described above.

Quick disconnect 150 is simpler than quick disconnect 50. Quick disconnect 50, however, does not require that the existing flange 36, with integral collar 34, be replaced. Thus, if it is difficult to remove flange 36 from barrel 12, quick disconnect 50 provides a solution. However, if flange 36 is readily removable from barrel 12, quick disconnect 150 may be preferred.

The operation of quick disconnect 150 is substantially similar to the operation of quick disconnect 50. The drummer, at the end of play, pulls lever arm 154 rotationally upward about pivot 258 of mount 66 and swings latch 152 about pivot 58 or 158 away from bracket 22 in FIG. 4A. In the illustrated embodiment of FIG. 4A, the drummer conveniently clips latch 152 to lever arm 154 via clip 156. Clip 156 may also be provided with quick disconnect 50 in the event that the handle of lever arm 54 is extended for disconnect 50. In FIG. 4B, hook portion 56*b* is extended so that latch 152 does not come free from bracket 22 when tension is released. The loop 56*b* and band 250 of hook 56*b* allow tension to be removed from head 14 without enabling drumhead 14 to come completely free from barrel 12.

To reapply tension to drumhead 14, the drummer places the head 56*a* of latch 152 of FIG. 4A over bracket 22 and pulls lever arm 154 rotationally downward into the snap-fit or locked position. For FIG. 4B, the drummer simply re-tensions or re-snaps arm 154. The drummer repeats this process for each of the quick disconnects 150 provided on drum 10, which supply tension collectively that is evenly distributed via tension ring 20 around drumhead 14.

Figure 5:
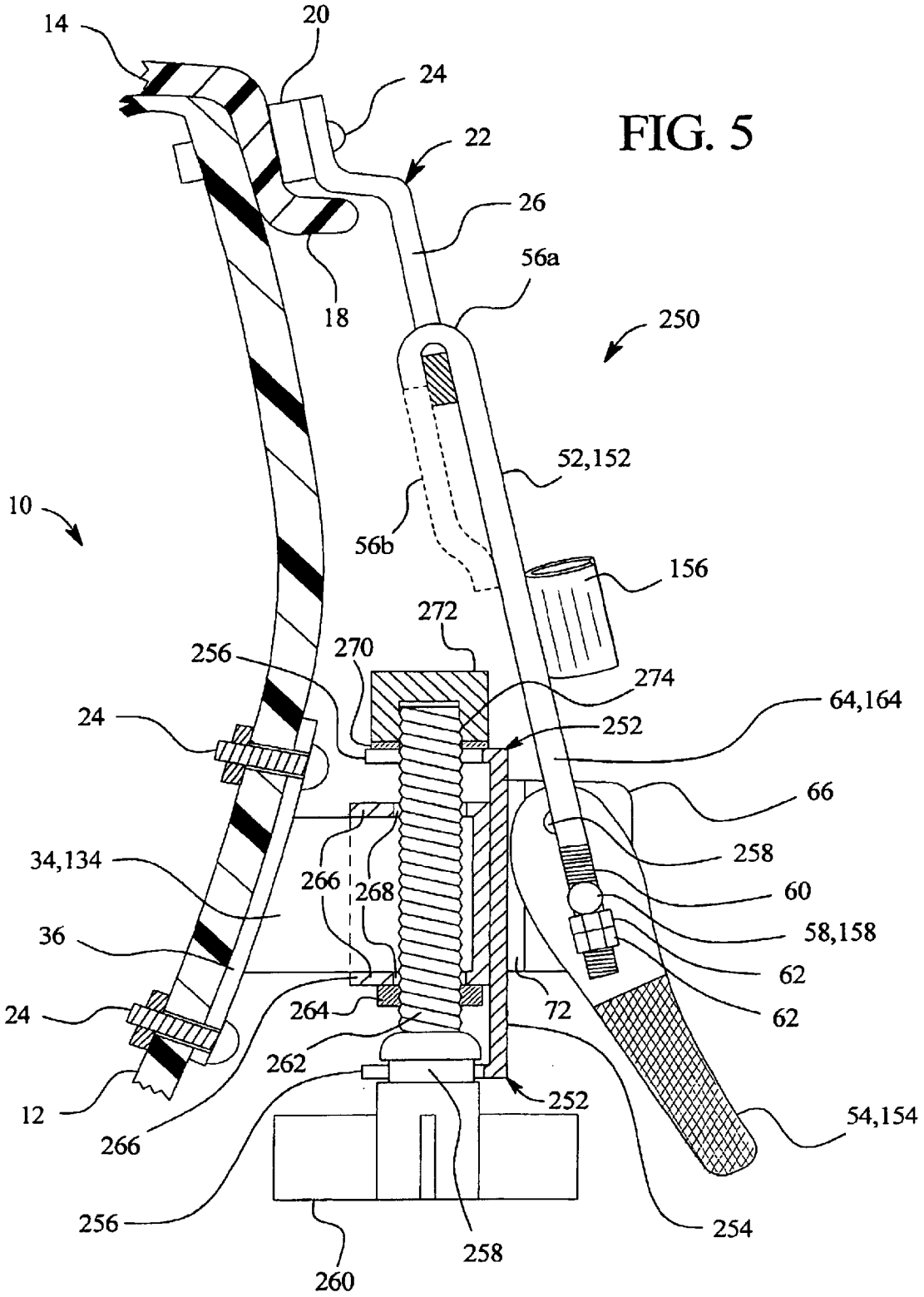
FIG. 5 is a sectioned side elevation view of still another alternative embodiment of the drumhead quick disconnect of the present invention.

Referring now to FIG. 5, a further alternative quick disconnect 250 is illustrated. Quick disconnect 250 includes many of the same components described previously, including a latch 52 or 152, having a hook end 56*a* or extended end 56*b* with band 250, segments 64 or 164, each having a threaded end 60, and optionally the clip 156 that clips to a handle portion of lever 54 or 154. Latch 52 or 152 couples pivotally to pivot 58 or 158. Lever arm 54 or 154, in turn, couples pivotally via pivot 258 to mount 66. Mount 66 includes a flange portion 72 that either bolts to or is welded to a C-shaped coupler 252. C-shaped coupler 252 includes a base 254 and a pair of horizontally U-shaped extensions 256. Lower U-shaped extension 256 forks around a groove 258 made in knob or handle 260. As illustrated, the cross-section of FIG. 5 is taken through the base 254 and a small portion of extension 256 until reaching the fork of the U-shape. The front fork is therefore cut away and not illustrated, exposing groove 258.

Knob 260 includes a threaded shaft 262 extending therefrom. Threaded shaft 262 threads through a nut 264, which is welded to the bottom of a U-channel 266. U-channel 266 fits over the existing collar 34 or a modified collar 134. That is, it may be necessary to extend and/or widen collar 34 to make a larger collar 134 to provide enough space to allow clearance for the handle or knob 260. U-channel 266 defines upper and lower apertures 268 that enable the threaded stud 262 to extend through the collar 34, 134 and through apertures 268 of U-channel 266. Threaded shaft 262 also extends through upper U-shaped extension 256 of C-coupler 252 as illustrated. A locking or spring washer 270 is provided between extension 256 and locking cap 272. Locking cap 272 can also have a nylon or other synthetic insert 274 that helps to lock cap 272 onto threads 262, against washer 270 and extension 256.

Collar 34, 134 is welded to or formed integrally with flange 36, which is fastened to barrel 12 via fasteners 24. To apply tension to drumhead 14 and to remove tension therefrom, lever arm 54, 154 and latch 52, 152 are operated as described above. The amount of tension applied by disconnect 250 can be varied by turning nuts 62, 162 with respect to threaded end 60, 160 of sections 64, 164. Alternatively, the tension is adjusted as described below.

The relatively large knob or handle 260 provides a greater amount of mechanical advantage to the drummer than does the nut 62 or larger adjustment device 162 of FIG. 3. Further, the single knob or handle 260 enables the drummer to maneuver a single device (per disconnect) to adjust drumhead tension. When the drummer turns handle or knob 260, the knob 260 and threaded shaft 262 rotate through nut 264 and therefore move vertically with respect to collar 34, 134 and drum 10. Groove 258 of knob or handle 260 likewise pushes or pulls C-coupler 252 up or down accordingly. The mount 66, latch 52, 152 and handle 54, 154 move accordingly with C-coupler 252. It should be appreciated that the relative spacing between knob or handle 260 and C-coupler 252 does not change, allowing a single-sized cap 272 to be used to lock the disconnect 250 in position, once that position is set.

The adjustment mechanism of disconnect 250 is operable whether disconnect 250 is engaged or disengaged to the bracket 22, which is coupled to tension ring 20 of drumhead 14. The drummer can therefore set the tension and the pitch of drum 10 before and after locking disconnect 250 into position. Upon disengagement, head 14 comes completely free if hook ends 56*a* are used and alternatively becomes loosely attached to barrel 12 if hook ends 56*b* are employed. Disconnect 250 makes easier the fine adjustment of the drum after tension is applied. That is, the tension applied via disconnect 250 should be substantially the same as the tension applied the last time drum 10 was played. However, if for whatever reason the drummer wants to modify the pitch or adjust the tension slightly, knob 260 provides fine tuning of the pitch. To fine tune the system, the drummer loosens cap 72, adjusts disconnect 250 up or down via knob or handle 260, and then retightens cap 272 to lock C-coupler 252 in position relative to barrel 12 of drum 10. That procedure is repeated one or more times for a plurality of disconnects 250 that are used in connection with drum 10.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A drumhead quick disconnect comprising:

a latch that operably engages and applies tension to a drumhead of a drum;

a lever arm that enables a person to move the lever in one direction to place the latch in a locked drumhead tensioning position and to move the lever arm in another direction to release the latch from the locked tensioning position;

an adjustment device that enables the person to position the latch relative to the cover to vary an amount of force applied by the latch when the latch is in the drumhead tensioning position, the adjustment device including a threaded shaft and an apparatus selected from the group consisting of: a nut thread onto the shaft and a handle for turning the shaft through a fixed female thread; and a mount coupled moveably to the lever arm, the mount configured and arranged to fasten the latch, lever arm and adjustment device to the drum.

2. The drumhead quick disconnect of claim 1, wherein the latch has a hook portion that loops over and engages a bracket fixed to the drumhead.

3. The drumhead quick disconnect of claim 2, wherein the hook portion is closed so as to not come completely free from the bracket.

4. The drumhead quick disconnect of claim 1, wherein the adjustment device varies a location of the latch relative to a point on the lever arm.

5. The drumhead quick disconnect of claim 1, wherein the mount includes a flange that abuts and fastens to a side of the drum.

6. The drumhead quick disconnect of claim 1, wherein the mount is configured and arranged to attach to a flange mounted to a side of the drum.

7. The drumhead quick disconnect of claim 1, wherein the mount defines at least two mounting holes that are configured and arranged to align with at least two mounting holes defined by the drum.

8. The drumhead quick disconnect of claim 1, wherein the adjustment device is sized to be turned by the person when the latch is in the cover pulling position.

9. The drumhead quick disconnect of claim 1, which includes at least one pivotal connection selected from the group consisting of: the latch being connected pivotally to the lever arm and the lever arm being connected pivotally to the mount.

10. The drumhead quick disconnect of claim 1, wherein the latch is coupled moveably to one of the lever arm and the mount so that the latch does not come free when the lever arm is unlocked.

11. A drumhead quick disconnect assembly comprising:

a drumhead of a drum;

a latch that operably engages and applies tension to the drumhead;

a lever arm that enables a person to move the lever in one direction to place the latch in a locked drumhead tensioning position and to move the lever arm in another direction to release the latch from the locked tensioning position; and an adjustment device that enables the person to position the latch relative to the cover, vary a location of the latch relative to the lever arm and vary an amount of force applied by the latch when the latch is in the drumhead tensioning position.

12. The assembly of claim 11, wherein the adjustment device includes a threaded shaft and an apparatus selected from the group consisting of: a nut threaded onto the shaft and a knob for turning the shaft through a fixed female thread.

13. The assembly of claim 11, wherein the adjustment device is sized to be turned by the person when the latch is in the cover pulling position.

14. The assembly of claim 11, which includes a mount coupled moveably to the lever arm, the mount configured and arranged to be fastened to the drum.

15. The assembly of claim 14, wherein the mount includes a flange that abuts and fastens to a side of the drum.

16. The assembly of claim 14, wherein the mount is configured and arranged to attach to a flange mounted to a side of the drum.

17. The assembly of claim 14, wherein the mount defines at least two mounting holes that are configured and arranged to align with at least two mounting holes defined by the drum.

18. The assembly of claim 14, wherein the latch is coupled moveably to one of the lever arm and the mount so that the latch does not come free when the lever arm is unlocked.

19. A drumhead quick disconnect assembly comprising:

a drumhead of a drum;

a latch that operably engages and applies tension to the drumhead;

a lever arm that enables a person to move the lever in one direction to place the latch in a locked drumhead tensioning position and to move the lever arm in another direction to release the latch from the locked tensioning position; and wherein the latch has a hooked portion that loops over and engages a bracket fixed to the drumhead.

20. The assembly of claim 19, wherein the hooked portion is closed so as to not come completely free from the latch.

21. The assembly of claim 19, which includes at least one pivotal connection selected from the group consisting of: the latch being connected pivotally to the lever arm and the lever arm being connected pivotally to the mount.

22. The assembly of claim 19, wherein the drum is of a type selected from the group consisting of: conga, bongo, djembe, ashiko, doumbek, tabor, bombo, klong yaw, taval, sakara, mridangam, hudak, naals, dhols, dholks, tupan, djun-djuns, coffeehouse, standing, tabla, talking, madal, zarb and and any combination thereof.

* * * * *